US005280935A

United States Patent [19]

Sobočan

[11] Patent Number: 5,280,935

[45] Date of Patent: Jan. 25, 1994

[54] SELF-PROPELLED SKATEBOARD

[76] Inventor: Boris Sobočan, Kvedrova 28, Ljubljana, Slovenia, 61000

[21] Appl. No.: 69,651

[22] Filed: Jun. 1, 1993

Related U.S. Application Data

[63] Continuation of Ser. No. 840,152, Feb. 24, 1992, abandoned.

[51] Int. Cl.[5] ..... B62M 1/04

[52] U.S. Cl. ..... 280/221; 280/11.115; 280/254; 280/87.042

[58] Field of Search ..... 280/11.115, 220, 221, 280/252, 253, 254, 87.042

[56] References Cited

U.S. PATENT DOCUMENTS

| | | | |
|---|---|---|---|
| 297,388 | 4/1884 | Hall | 280/11.115 |
| 936,173 | 10/1909 | Schoenberg | 280/11.115 |
| 1,208,173 | 12/1916 | Lenhardt | 280/11.115 |
| 1,364,471 | 1/1921 | Ameli | 280/221 |
| 1,535,950 | 4/1925 | Schramke | 280/221 |
| 2,061,334 | 11/1936 | Stone | 280/11.115 |
| 3,399,906 | 9/1968 | Portnoff | 280/221 |
| 4,181,319 | 1/1980 | Hirbod | 280/11.115 X |
| 4,411,442 | 10/1983 | Rills | 280/87.042 X |
| 4,451,055 | 5/1984 | Lee | 280/11.115 X |
| 4,861,054 | 8/1989 | Spital | 280/11.115 X |
| 4,915,403 | 4/1990 | Wild et al. | 280/221 |

*Primary Examiner*—Margaret A. Focarino
*Assistant Examiner*—Michael Mar
*Attorney, Agent, or Firm*—Keck, Mahin & Cate

[57] ABSTRACT

A footboard of a skateboard is with respect to a respective reference plane which at riding straight (=x plane) is parallel to the riding path (=the ground), and at turning (=x″ plane) is with respect to the direction of riding slanted to one or the other side, is rhythmically swung around a longitudinal axis (O) of swinging lying in suspensions (4, 5) of the skateboard. The amplitude (A) and the frequency of swinging are mutually coordinated in a manner that swinging does not result in such meandering of the skateboard, which was felt inconvenient.

To a socket shaft housing (8) of a suspension (4, 5) of the skateboard, said housing encasing a roller shaft (11), there is to each end thereof attached a gearing (9, 10), the gearings designed mirror-symmetrically. The gearing (9, 10) is composed of an essentially three-part housing assembly, which comprises a mounting casing (13), an upright intermediate wall (16) and a mounting cover (17), as well as of a train-type gearing composed of a toothed rack (19) as a driving constituent and a gear (25) bound to the roller shaft (11), as a driven constituent. In addition to the roller shaft (11) which passes through, two further, inner shafts (14, 15) constitute said gearing, the lastmentioned shafts each supporting two gears (20, 21; 23, 24), the first one (20) thereof mating the toothed rack (19) and the last one (24) mating the gear (25) driven. The second one (21) of the gears is indirectly connected to the respective shaft (14) by means of an over-running clutch (22), and shaft (14) is by means of a suitably pre-stressed helical torsion-spring (28), which encompasses the shaft (14), rotationally-elastically bound to the stationary mounting casing (13) of the gearing.

3 Claims, 7 Drawing Sheets

SELF-PROPELLED SKATEBOARD

This is a continuation of application Ser. No. 07/840,152, filed Feb. 24, 1992, now abandoned.

FIELD OF THE INVENTION

The present invention relates to the field of sports/-games/recreation, and particularly relates to skateboards which provide special, integrated measures for physically driving the skateboard.

BACKGROUND OF THE INVENTION

In a primary configuration, a skateboard comprises an elongated, suitably designed footboard from which two pairs of rollers are suspended. Optionally, a skateboard can further comprise supplementary equipment, e.g. a brake, a flywheel, a lamp, a marker, a buffer, etc. Normally, in the course of skateboarding, turning is made possible when the footboard of skateboard is parallel to the skateboarding path while riding straight by slanting the footboard to either side with respect to its longitudinal axis. This action can be realized by means of a specific suspension of the rollers. For performing a curve, the inclination of the footboard results in a front and a rear roller, the "inner" rollers with respect to the curve, being mutually drawn together, whereas the other two rollers, the "outer" ones with respect to the curve, are mutually drawn apart.

It is obvious that proper propelling of the skateboard is performed by the rider pushing off from the ground (and/or by riding downhill) so that a skateboard/rider-system as a physical phenomenon, i.e. skateboard and rider functionally united into a combined, independent unit, can be discussed merely within the period of the consumption of mass forces previously accumulated (or—in the case of riding downhill, by using gravity force).

Attempts to assign to a skateboard/rider-system the character of a physical phenomenon without using gravity force or a special source of energy, respectively, i.e. solely on the basis of the physical engagement of the rider, are known.

From U.S. Pat. No. 4,915,403 to Wild et al. a "skateboard with a mechanical drive" is known, having a footboard which is, in the area of the middle of the longitudinal extension of the footboard, transversely divided into a front, fixed section, and a rear, pedal section. The footboard sections are interconnected by a skateboard frame. The pedal section is, by means of linkages comprising push rod, a crankshaft and a toothed segment, as well as by means of a gear train bound to the toothed segment and comprising four pairs of toothed wheels and a termination toothed wheel, which is bound to a roller shaft of the rear skateboard rollers, motion-transferably interconnected with respective skateboard rollers, each of which is connected to the shaft by means of an overrunning clutch.

According to the above reference, the skateboard provided essentially has the same height as skateboards without propelling gearings, and diverse operational possibilities are retained, such as ease in negotiating curves and maneuverability.

However, the height of the skateboard of Wild can only be discussed in connection with the front, i.e. fixed, footboard section of the skateboard, not in connection with the rear, i.e. pedal section, except at a position when its pedal function is arrested which, however, is not in confirmity with the primary aim or object of the solution. Analogously, regarding the "diverse possibilities" the following points are noted. Curves can easily be negotiated and the skateboard easily handled under the condition only that the pedal function is arrested, i.e. both footboard sections straightened to be coplanar. In the state when the skateboard is physically pushed, only the rider's foot resting on the front footboard section of the skateboard is left to accomplish normal riding ("normal" meaning the possibilities offered by the skateboards without propelling gears). Thus, the maneuverability is obviously and considerably affected. So, for example, the possibility of making jumps, when the pedal section is lifted, is totally excluded.

Further, the length of the footboard of the skateboard is limited to a length of at least two feet and there is a danger of toppling on one side or the other with respect to the direction of riding as well as backwards over the rear rollers (as a consequence that propelling tends to jerk the skateboard from under the rider's feet).

From the functional point of view the known solution shows a further disadvantage which cannot be neglected, namely the driving torsional moment is enforced intermittently: a driving phase is followed by an idle one, the latter is followed by a driving phase, etc.

SUMMARY OF THE INVENTION

It is now an object of the invention to overcome the disadvantages set forth above, and to provide a skateboard which can physically be driven by means of movements proper to a rider used to riding skateboards without driving gears.

For negotiating curves, the footboard of a skateboard is tiltable within limits, whose extreme values are defined by constructional measures, and that reasonably rapid swinging of the footboard, limited to a correspondingly small angle, with respect to a given plane which is horizontal for straight riding and is in negotiating a curve, tilted to the direction of the geometrical center of the curve, in practice generates no perceivable meandering of the skateboard. The invention is based on converting swinging of the footboard to propelling of the rollers of a skateboard.

According to the invention, a method of providing a self-propelled physical skateboard/rider-system, based on a skateboard which includes a gearing for transforming an action force of the rider to a moment of rotation for driving the skateboard, and further based on a rider, who is correspondingly, at least basically, experienced, is characterized in that a footboard of a skateboard is, with respect to a respective reference plane, which at riding straight is parallel to the path (the ground), and is, on turning, with respect to the direction of riding, slanted to one or the other side, rhythmically swung around a longitudinal axis of swinging lying in a plane of the suspensions of the skateboard. The amplitude of swinging which, preferably, is as small as possible, and the frequency of swinging which, preferably, is as high as possible, are mutually coordinated so that swinging does not result in a noticeable inconvenient meandering of the skateboard.

According to the invention, a skateboard for realizing the method defined above includes a train-type interconnection between the footboard of the skateboard and a roller shaft of the skateboard, whereby each roller of the skateboard is connected indirectly with a respective roller shaft by means of an overrunning clutch. A basic design includes a socket shaft housing of a suspension, the housing encasing the roller shaft, and a gearing mechanism is attached to each end of the housing.

A skateboard of this type is further characterized in that to a socket shaft housing of either suspensions, with the housing holding the roller shaft, a gearing mechanism is attached to each end of the roller shaft.

For either a basic or a preferred embodiment of the skateboard, the gearings of the front and/or rear roller shaft are designed as mirror images with respect to a longitudinal upright plane placed through the suspensions.

Each gearing mechanism includes a mounting casing attached to the shaft housing and closed in the direction towards the respective roller of the skateboard by an upright wall to which a mounting cover oriented to the mounting casing is connected, with bearings both in the mounting casing and the mounting cover for journalling the roller shaft and gearing shafts, a vertical toothed rack guided by a guide, the latter being a constituent of the intermediary wall, the rack extending through a recess of the ceiling wall of the mounting cover and further extending up to the footboard, a pinion mating the toothed rack, as well as pairs of gears which constitute a train-type interconnection of the toothed rack and the roller shaft, with the last gear mentioned being arranged on the roller shaft, and a suitably pre-stressed retracting helical torsion-spring which interconnects the shaft of the pinion and the mounting casing so that at lowering the toothed rack the spring is tightened, whereby the gear next to the spring is by means of an appropriate overrunning clutch indirectly connected to the shaft common to the spring and the gear.

The preferred exemplary embodiment of the invention will hereinafter be described in conjunction with the figures, wherein like designations denote like elements.

DETAILED DESCRIPTION OF THE PREFERRED EMBODIMENTS

Figure 1:
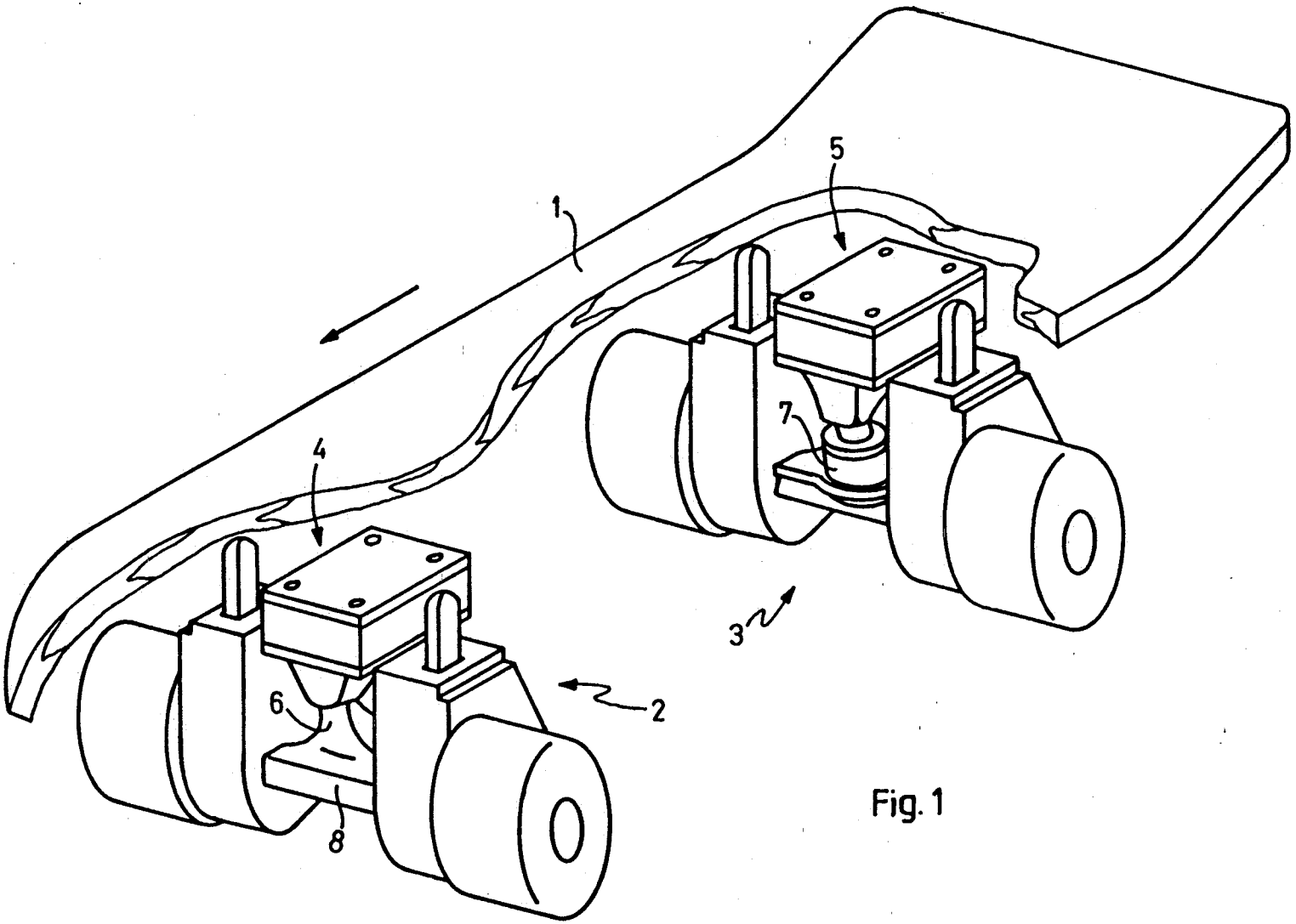
FIG. 1 is a schematic view of a skateboard of the invention, with the footboard of the skateboard cut away to expose the substructure of the skateboard.
Figure 2:
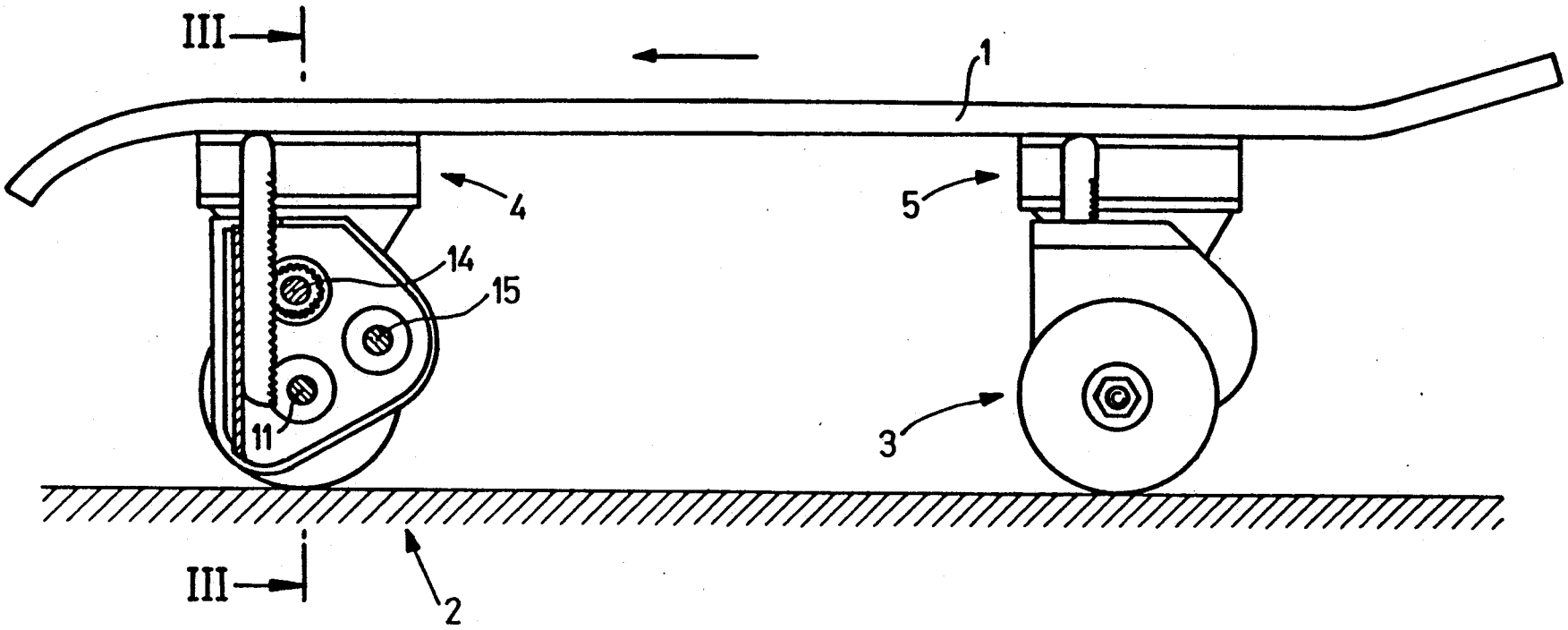
FIG. 2 is a side elevational view of a skateboard of FIG. 1, with the front wheel assembly shown in cross section.

The skateboard comprises a footboard 1 which is composed and designed in accordance with the respective objects and having on a lower side a front substructure assembly 2 and a rear substructure assembly 3 suspended at the front and the rear end sections, respectively. The connection of the footboard 1 and the substructure assemblies 2, 3 is a direct one, similar to that of skateboards without incorporated driving gearings.

The substructure assembly 2, 3 has a two-column suspension 4 (front); suspension 5 (rear) which, as such, belongs to the prior art. The two suspensions 4, 5 are structurally equal to each other, and arranged in known manner mirror-symmetrically with respect to a vertical central plane positioned transversely to the direction of the movement of the skateboard. When observing the representation of FIG. 1, the structural feature just mentioned appears such that of the two-column suspension 4 of the front substructure assembly 2, a rigid, internally rotatable and breakable column 6, and of the two-column suspension 5 of the rear substructure assembly 3, respectively, an elastically flexible column 7, is visible.

The columns 6, 7 of either suspension 4, 5 are arranged in a V-relation in the central longitudinal vertical plane of the skateboard, which feature, in combination with other features of the suspensions 4, 5, makes it possible that on tilting of the footboard 1 to the left or to the right, respectively, with regard to the direction of riding the skateboard, the front substructure assembly 2 and the rear substructure assembly 3 are definitely swung in opposite directions—each assembly around its own vertical axis, which coincides with the axis of the rigid column 6. These shiftings in functional meaning result in turning of the skateboard.

Except in view of the mentioned feature that the suspensions 4, 5 are arranged as mirror images, the front substructure assembly 2 and the rear substructure assembly 3 are structurally equal to each other. In order to simplify the description of the skateboard, only the front substructure assembly 2 and the front suspension 4 will hereinafter be referred to, but will include the rear substructure assembly 3 and the rear suspension 5.

According to the invention there is to each side (=end) of a shaft housing 8, the latter arranged crosswisely to the columns 6, 7 at the root section of the V-arrangement of said columns of the suspension 4, attached a gearing 9, 10, said gearings being preferably designed so as to create mutual mirror-symmetry with respect to the intermediate vertical longitudinal plane of the skateboard.

A roller shaft 11, bearing at its free end sections skateboard rollers 12, is inserted through the shaft housing 8 and the gearings 9,10.

For the solution of the problem of the invention it is really indispensable to provide a pair of gearings 9, 10 for each shaft 11. In principle, the installation of gearings at both shafts, i.e. at the front and at the rear roller shaft, is optional but the tests performed, as well as diverse practical aspects (which will be discussed in more detail later), lead to the conclusion that it is convenient to use two pairs of gearings as shown in FIG. 1. Possible initial doubts as to the effect that the gearings in the arrangement mentioned might result in an aimless constructional jamming of the skateboard, disappear on becoming aware that according to the invention the suspensions which, as generally known, are "critical" (and therefore expensive) components of skateboards, need not be divided to front/rear and left/right ones, respectively, as is the case in the prior art analyzed.

Figure 6:
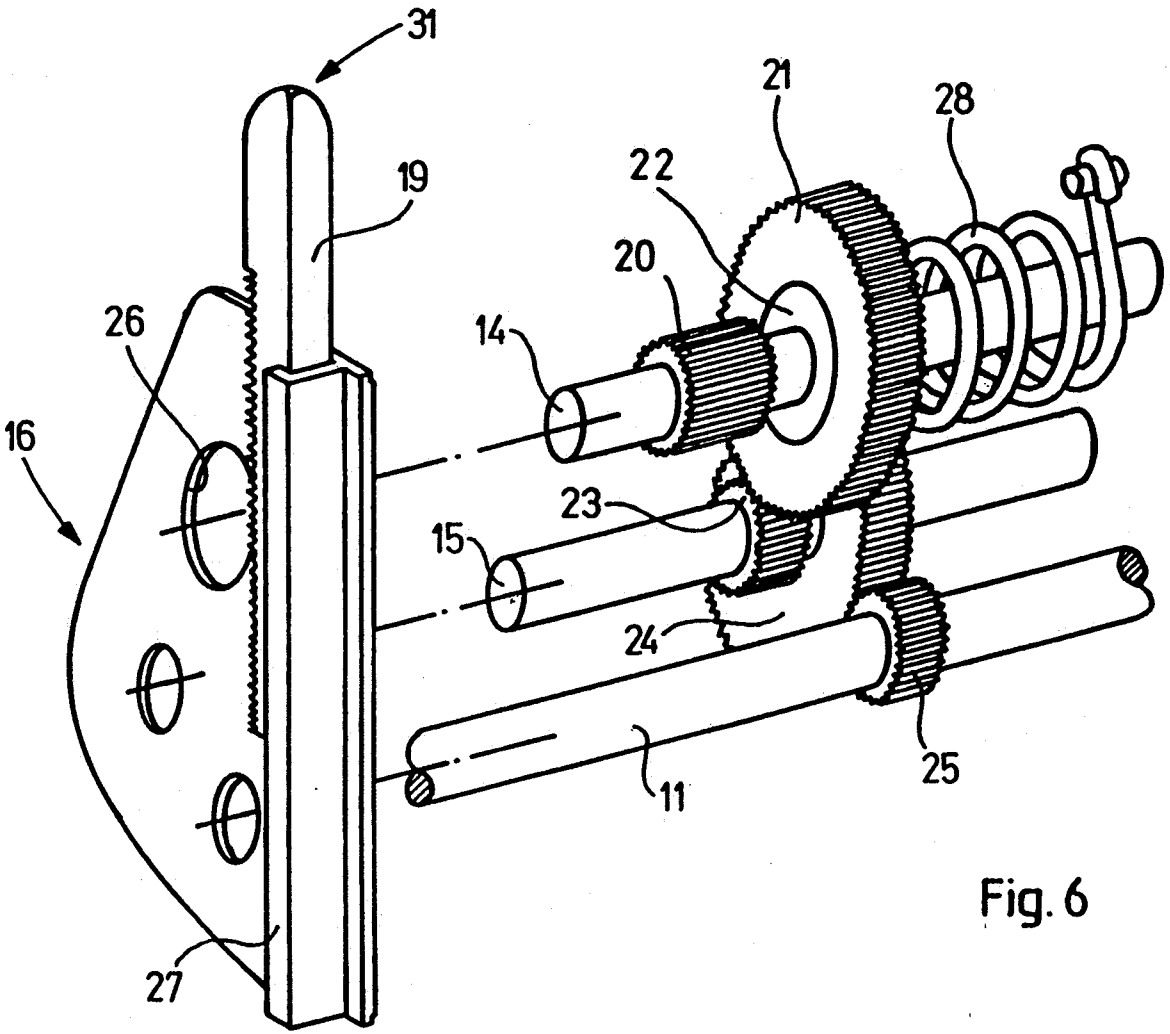
FIG. 6 is a schematic view of a gearing on the right side with respect to the riding direction, partly taken apart.

The gearing 9 according to the invention is composed of a box-shaped mounting casing 13 which is attached to the free end of the shaft housing 8 and in which, beside the roller shaft 11, a shaft 14 for carrying gears, conveniently disposed above the roller shaft 11, and an intermediate shaft 15 also for carrying gears, disposed by height between the shafts 11 and 14, but shifted rearwards with respect to the direction of riding the skateboard, are mounted. On the side oriented to the roller 12 of the skateboard, the mounting casing 13 is closed by a vertical wall 16 (please also compare FIG. 6). Finally, attached to the latter is a mounting cover 17, which provides another series of bearings for pivoting the shafts 11, 14, 15. In the ceiling part of the wall of the mounting cover 17 there is, directly at the wall 16, a recess 18 for conveying a toothed rack 19 as explained below.

The shaft 14 supports a pinion 20 which is directly bound to the shaft and cooperates with the toothed rack 19, as well as a further gear 21, which is by means of an overrunning clutch 22 (e.g. a grip roller and expanding friction clutch) connected to the shaft 14. The pinion 20 resides inside the mounting cover 17 and projects into an appropriate circular recess 26 of the wall 16, whereas the gear 21 accompanied by its overrunning clutch 22 resides inside the mounting casing 13 and is arranged at an axial distance from the journal of the shaft 14.

The intermediate shaft 15 supports a gear 23 designed to mate with the gear 21. Gear 21 has a diameter greater than that of gear 23, and on the side oriented to the vertical wall part of the mounting casing 13 supports a further, larger gear 24. The two gears 23, 24 are directly connected to the intermediate shaft 15.

The roller shaft 11 supports a gear 25, driven and designed to mate with the gear 24, whose diameter is larger than that of gear 25. Gear 25 and shaft 11 are directly connected.

Recesses to convey shafts 11, 15 analogous to recess 26, are provided in the wall 16. Wall 16 also provides an upright trough-shaped guide 27 (FIG. 6) for accommodation and guiding of upright toothed rack 19, the inner cross-section of the guide 27 coinciding with the recess 18.

Figure 5:
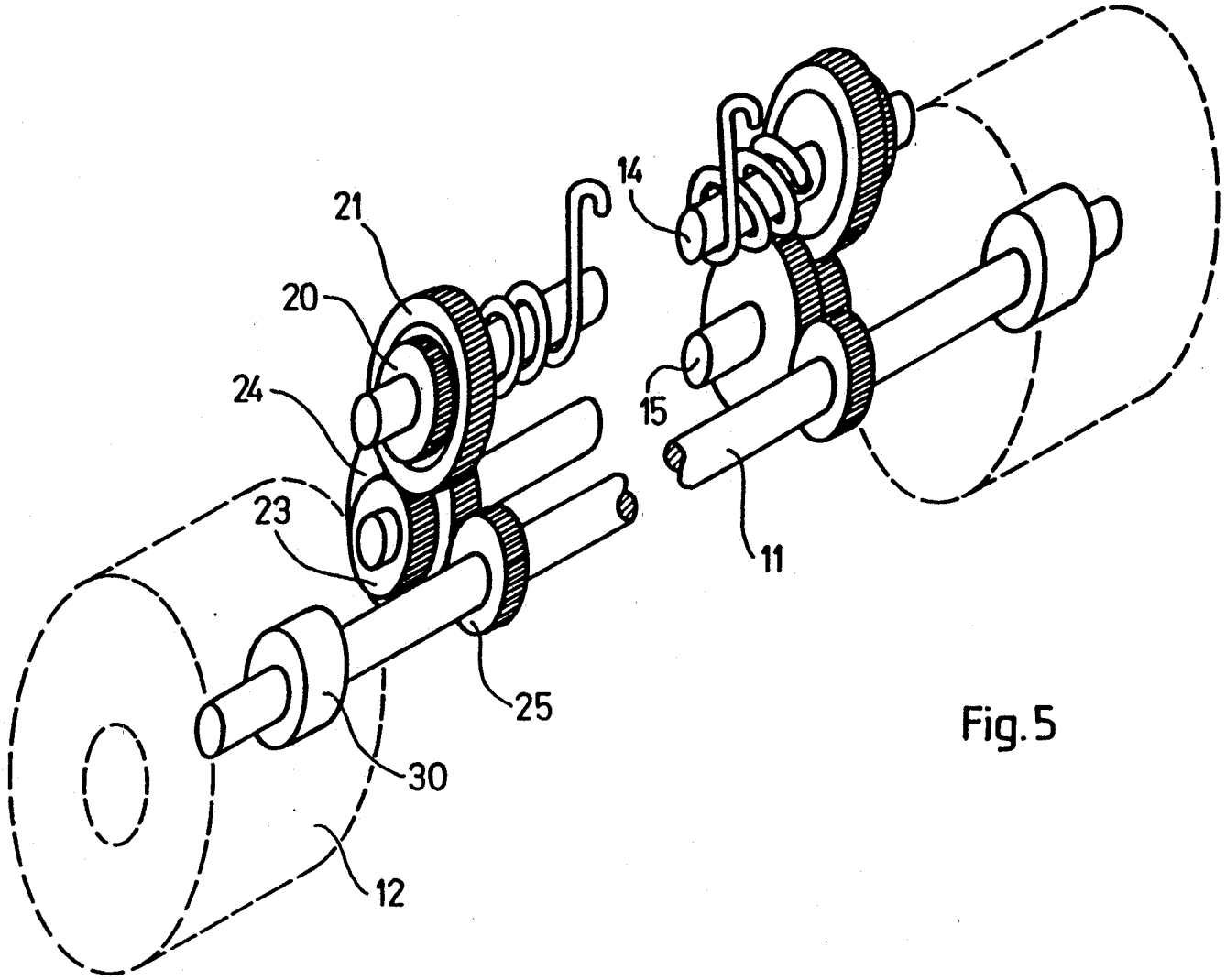
FIG. 5 is a schematic view of a pair of gearings (without respective toothed racks) of an axle (front or rear) of the skateboard.

On shaft 14, in the axial interspace between the gear 21 and its overrunning clutch 22, respectively, and the bearing of the shaft 14, a suitably pre-stressed helical torsion-spring 28 is located, whose one end is formed like a hinge and is, by means of tangential approaching to the surface mantle of the shaft 14, connected to the latter, and whose other end is designed like a hook and is thereby connected to the mounting casing 13. The windings of the spring 28 are tightened when the toothed rack 19 is moved down, i.e. they accumulate potential energy necessary for returning (lifting) the toothed rack 19 to its original position. It is clearly evident from FIG. 5 that, in the case of existence of two gearings 9, 10 bound to a respective roller shaft 11, one of the two springs 28 is coiled right-handedly and the other one is coiled left-handedly. An embodiment of a left-hand coiled helical torsion spring 28 is pictorially represented in FIG. 6.

The gearing is designed on the principle that one stroke of the toothed rack 19 results in one revolution of the shaft 14. Naturally, at a complete revolution of the shaft 14 the windings of the spring 28 do not thoroughly clamp the mantle surface of the shaft, and the ability of springness-accumulation of the spring is thereby not thoroughly exhausted.

Figure 3:
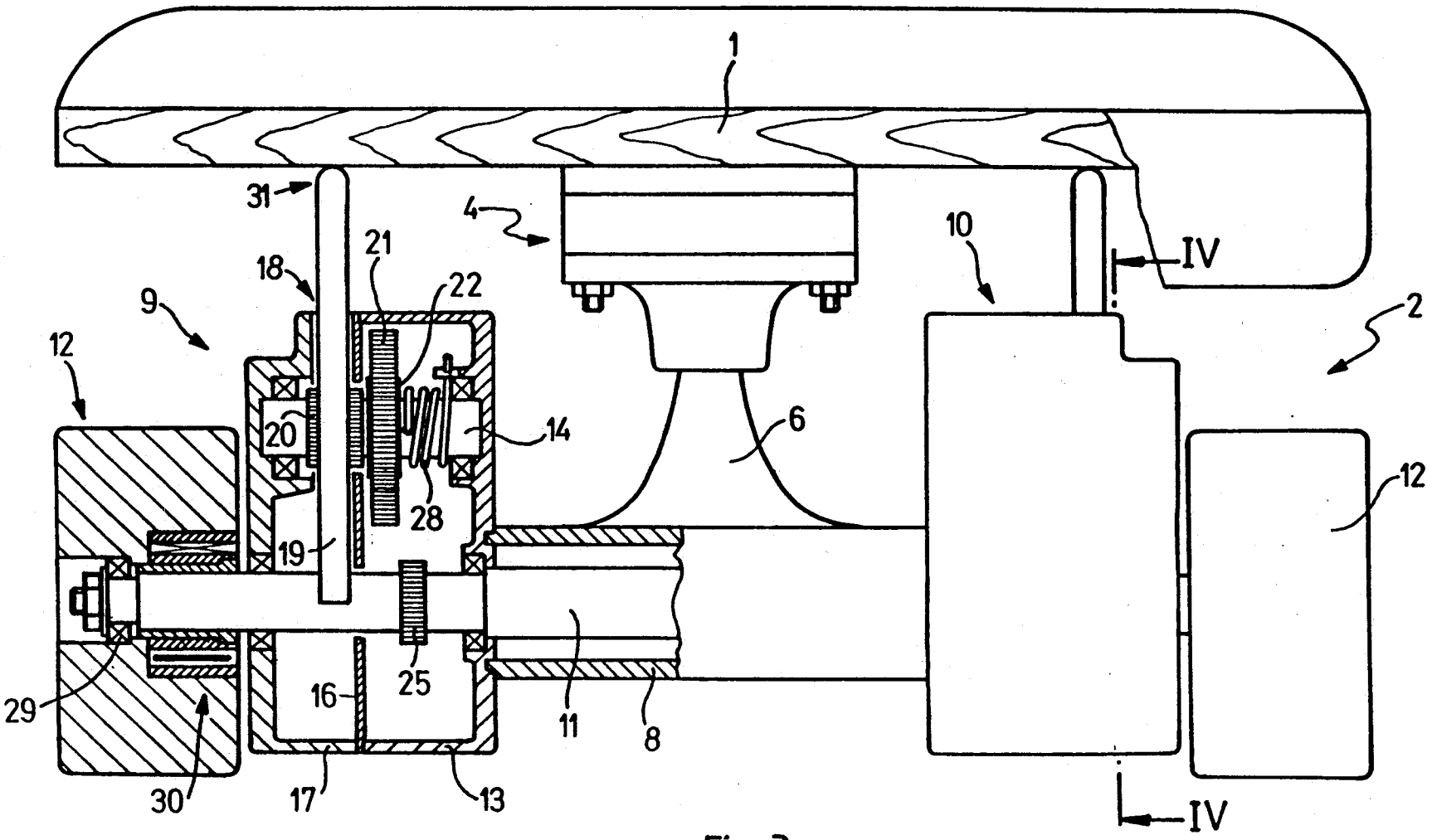
FIG. 3 is a front elevational view of a skateboard of FIG. 2 from the left (i.e. the front view), with the section relating to the front right roller represented as a vertical sectional elevation which corresponds to line III—III of FIG. 2, and shows a corresponding toothed rack not covered by the sectional plane (one of axles and accompanying two gears omitted to improve the clarity of the drawing).
Figure 4:
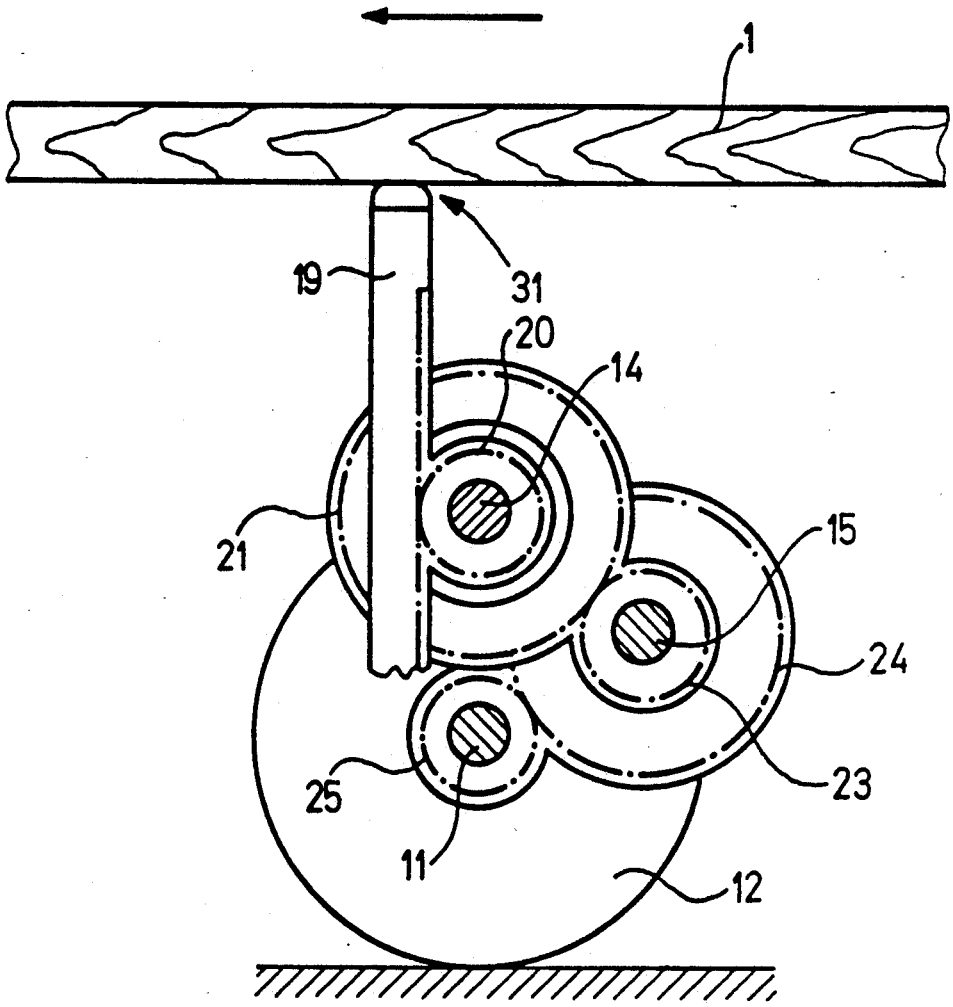
FIG. 4 is a cross-sectional elevation view taken on line IV—IV of FIG. 3.

The interconnection of the shaft 11 and the roller 12 is taken from the prior art and designed by providing a roller bearing 29 (FIG. 3) and an overrunning clutch 30.

In a preferred embodiment of the invention there is with respect to the overrunning clutch 30 belonging to the roller 12, as well as with respect to the overrunning clutch 22 which belongs to the gear 21, among known overrunning clutches chosen the one designed on two mutually movable rings inserted one into another and each carrying an appropriate series of roller needles, whereby the inclination sections are in the outer ring (a patent to TORRINGTON company). The two overrunning clutches 22 of rollers 12 bound to a common shaft 11 thus work in the same direction of rotation.

FIGS. 1 through 6 represent a skateboard which is neutral with respect to the footboard 1 and is balanced with respect to the spring 28. The four toothed racks 19 are forced upwards to the footboard 1 under the influence of the returning forces of the springs 28.

Figure 7:
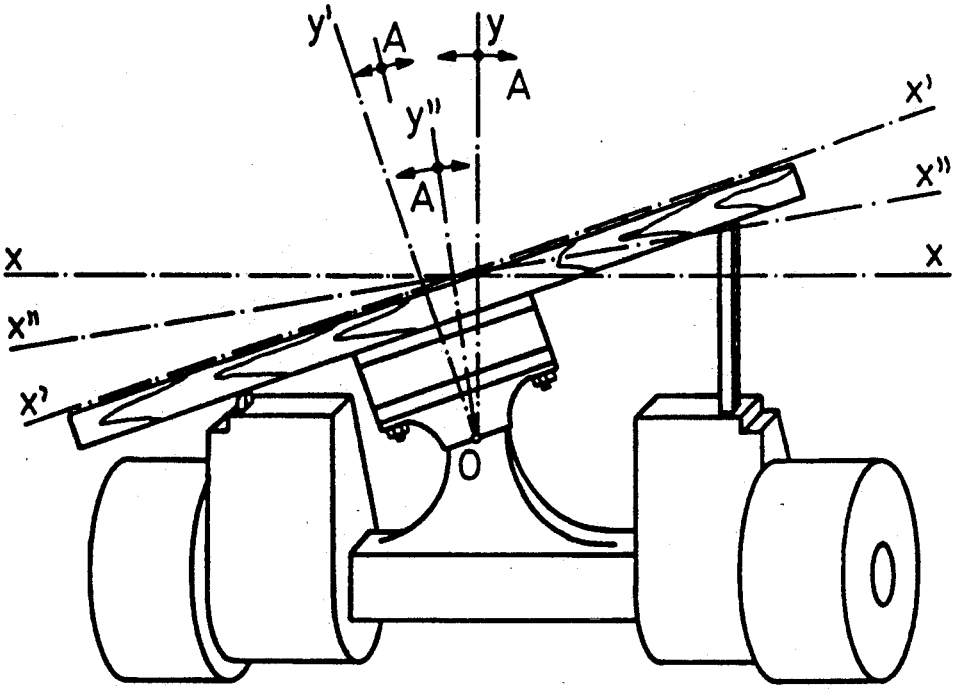
FIG. 7 is a schematic front or rear view of the skateboard, having an extremely tilted footboard, the geometry of swinging being shown.
Figure 8:
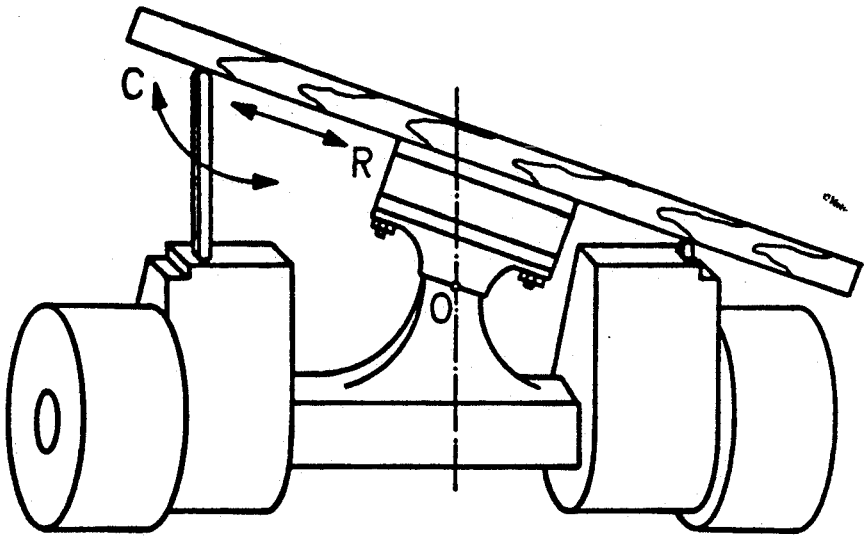
FIG. 8 is a view analogous to FIG. 7 showing the opposite tilting of the footboard.

Contraty to the above mentioned state, FIG. 7 schematically represents a skateboard having a footboard 1 tilted to one of two limiting positions by force, FIG. 8 representing a state corresponding to tilting the footboard into the opposite limiting position. The two springs 28 referring to the toothed racks 19, which are pushed down by the footboard 1, are then tightened (stressed), the other ones are then slack (loose). When riding, the positions shown in FIGS. 7–8 represent negotiation of curves by the skateboard in one or the other direction.

FIG. 7 comprises three plane coordinate systems corresponding to the swinging axis O of the footboard 1. The x-y system denotes the position of the footboard 1 when riding straight, the x'-y' system denotes the position thereof at extreme turning to one direction (an analogous position as to extreme turning to the other direction being represented in FIG. 8), and the x''-y'' system denotes an optional intermediate position of turning the skateboard, i.e. slight turning. Arched arrows A added to the ordinate planes y, y', y'' in FIG. 7 indicate the possibility of performing the swinging of the footboard with respect to the respective ordinate planes in the course of riding on a skateboard, with the amplitude of swinging each reasonably measured off. In principle or advantageously, respectively, there is foreseen that in the case of all arrows A, essentially the same angle of swinging is in question although the choice of the extent of swinging as such is within the individual discretion or the user's mastering of the rolling technique, and the extent both depends on the embodiment and riding features, respectively, and is structurally limited to one or the other side merely by the extreme possible tilting position here indicated by the x'-y' system.

The swinging of the footboard 1, as explained above, is in accordance with the fundamental conception of the invention, as defined in the introduction, exploited in the range of angles indicated by the arcuate arrows A for generating the propelling of the skateboard. Experiments have shown that swinging generated by a reasonably high frequency and reasonably small amplitude with respect to an optionally chosen plane y, y'', naturally without exceeding the limit plane y', does not result in risky, uneven riding of the skateboard (in fact, swinging essentially means creating miniature curves, i.e. meandering). However, it can be exploited as an appropriate basis for generating an appropriate propelling moment of rotation. The circumstance that the gearing 9 is unavoidably embodied as a "light" one, is an obvious accompanying feature of the concept as set forth above. Having provided both roller shafts 11 with gearings 9, which means that the driving load is every time divided between two gearings 9, the skateboard as a whole meets the requirements regarding solidity, typical for articles of this type.

A skateboard according to the invention provides possibilities for starting riding either by pushing off the ground (similarly to skateboards without a driving mechanism) or by treading on the footboard and starting swinging of the footboard of the skateboard.

When pushing the toothed rack 19 of the gearing 9 downwards, the shaft 14 obtains levorotation; the overrunning clutch 22 is thrown in gear and hence the gear 21 rotates as well. The rotation of the shaft 14 is followed by tightening of the spring 28. From the gear 21 the rotational moment is conveyed to the gear 23, by means of the latter it is conveyed to the gear 15 and hence to the gear 24, which gears are thus turned dextrorotatorily. From the gear 24 the rotational moment is conveyed to the gear 25 now driven, and by means of the latter conveyed to the roller shaft 11. Evidently, the gear 25 and the shaft 11 obtain levorotation; the overrunning clutch 30 of the roller 12 is put into gear. It is a result of the transmission disclosed that a stroke of the toothed rack 19 is converted into propelling rotation of the roller 12.

At realization of the above disclosed working stroke of the toothed rack 19 of the gearing 9, the toothed rack of the gearing 10 belonging to the same roller shaft 11 follows the lifting of the footboard of the skateboard under the influence of the force of unwinding the respective spring. Hereby, the connection of the shaft 14 and the gear 21 of the gearing 10 is broken by means of the overrunning clutch.

At turning, particularly at sharp turning, the difference between the number of revolutions of the outer rollers and the inner rollers 12 cannot be neglected, in principle. The possibility is not excluded that in the case of realizing the above disclosed swinging, also in the course of turning of the skateboard, the drive actively influences merely the inner roller 12, which rotates slower, i.e. the number of revolutions of the outer roller might exceed the one really attained by the gearing. In this case the overrunning clutch 30 of the outer roller enables free rotation of the latter.

Naturally, the overrunning clutches 30 are also necessary for riding a skateboard backwards, in that case without putting the driving gearings into gear.

From the above discussion, it follows that with respect to the lower side of the footboard 1 the tip portion of each toothed rack 19 performs a motion (FIG. 8) composed of a straight, radial component R created by tilting the footboard 1 i.e. by swinging the footboard 1 around the longitudinal axis O, and also composed of a circular component C created by swinging the substructure assembly 2, 3 to perform turning, i.e. by swinging around the vertical main axis of the suspension 4, 5. In order to avoid the risk of possible non-reversibility of the footboard 1 and the toothed rack 19, there is at the top of each toothed rack 19 foreseen a ball bearing 31, known per se, not represented in the drawing.

I claim:

1. In a skateboard having an elongated footboard straddling a central longitudinal vertical plane for the skateboard, forward and rearward longitudinally spaced suspensions secured to a bottom surface of the footboard, a pair of laterally spaced rollers carried by each suspension, each of said suspensions including a roller shaft for mounting said pair of rollers, said forward and rearward suspensions being arranged in a V-relationship to define a central longitudinal swing axis extending through said forward and rearward suspensions, each of said suspensions having a resilient mounting for each roller shaft so as to permit pivotal movement of the roller shaft and thus steering of the skateboard in response to a swinging movement of the footboard by a user about said longitudinal swing axis, and drive means located on opposite sides of the central longitudinal vertical plane of at least one of said forward and rearward suspensions, each of said drive means including a resiliently biased, vertically mounted, reciprocative, elongated drive member having an upper end in sliding engagement with the bottom surface of the footboard, said drive member being operatively connected to said roller shaft for driving the roller shaft in response to swinging movement of the footboard about the longitudinal swing axis.

2. In a skateboard according to claim 1 wherein a ball bearing is mounted in the upper end of the elongated drive member to facilitate sliding engagement with the bottom of the footboard.

3. In a skateboard according to claim 1 said drive member comprises a vertically oriented rack, guide means for slidingly engaging said rack for vertical reciprocation, said rack being engageable by the bottom surface of said footboard for reciprocation downwardly, gear transmission means in driving engagement with said rack on an input side and drivingly engaged with the roller shaft on an output side to drive said roller shaft responsive to downwardly reciprocation of said rack, said gear transmission means including clutch means and resilient means for normally holding said rack close to the bottom surface of said footboard and for reciprocating said rack vertically upwardly in response to said footboard engaging and reciprocating said rack downwardly and releasing said rack to allow for upwardly reciprocation.

* * * * *